United States Patent [19]

Stengle et al.

[11] 4,438,914

[45] Mar. 27, 1984

[54] CLOTH LAYING MACHINE

[75] Inventors: Rolf Stengle; Rolf Grupp, both of Stuttgart, Fed. Rep. of Germany

[73] Assignees: Krauss u. Reichert GmbH & Co.; KG Spezialmaschinenfabrik, both of Fellbach, Fed. Rep. of Germany

[21] Appl. No.: 288,357

[22] Filed: Jul. 30, 1981

Related U.S. Application Data

[63] Continuation of Ser. No. 70,712, Aug. 29, 1979, abandoned.

[30] Foreign Application Priority Data

Sep. 2, 1978 [DE] Fed. Rep. of Germany ..... 2838410

[51] Int. Cl.[3] ..... B65H 29/46

[52] U.S. Cl. ..... 270/31

[58] Field of Search ..... 270/30–31; 493/450, 410–415; 38/14–16

[56] References Cited

U.S. PATENT DOCUMENTS

| | | | |
|---|---|---|---|
| 2,326,459 | 8/1943 | Hansen | 270/31 X |
| 3,423,083 | 1/1969 | Sherrill | 270/31 X |
| 3,677,536 | 7/1972 | Paterson | 270/31 |

FOREIGN PATENT DOCUMENTS

| | | | |
|---|---|---|---|
| 975394 | 9/1975 | Canada | 493/413 |
| 1180236 | 10/1964 | Fed. Rep. of Germany . | |
| 1280205 | 10/1968 | Fed. Rep. of Germany . | |

*Primary Examiner*—A. J. Heinz

*Attorney, Agent, or Firm*—Bernard, Rothwell & Brown

[57] ABSTRACT

A cloth laying machine for laying out on a supporting surface superimposed layers of cloth drawing from a web of cloth supplied. A carriage includes an apparatus for traversing or reciprocating the carriage in two directions for laying out in at least one of these directions a cloth on a substantially horizontal supporting surface. A blower mechanism is included in the apparatus for generating an air current flowing from above and directed downwardly toward the substantially horizontal layer of cloth which has been or is about to be laid on this supporting surface.

17 Claims, 7 Drawing Figures

CLOTH LAYING MACHINE

This is a continuation of application Ser. No. 070,712 filed Aug. 29, 1979, now abandoned.

The invention relates to a cloth laying machine for laying out on a supporting surface such as a table, conveyor belt or the like, superimposed layers of cloth drawn off a web of cloth supply. Such cloth laying machines are known, for example, from German Offenlengungsschrift 2 316 706 and the corresponding U.S. Pat. No. 3,677,536.

When particularly light-weight fabrics are laid out by conventional cloth laying machines, folds tend to form therein on the cloth laying table. Lengthwise folds are mainly due to a distortion in the longitudinal direction which is evident after the cloth has been drawn off from the web of cloth supply and results in a decrease in the width of the web of cloth, which is the same shape as a web of cloth roll carried by the cloth laying carriage of the cloth laying machine. Once the layers of cloth are laid out on the cloth laying table, folds form in the longitudinal direction of the web of cloth.

When light-weight fabrics are being laid out they fall so slowly and unevenly on account of their light weight that crosswise folds may also occur during the necessarily slow laying out operation. Folds cannot be tolerated because they produce faulty cuts when the cloth is subsequently cut according to a given pattern, which results in waste.

The unavoidable lengthwise distortion caused by drawing off the web of cloth from the web of cloth supply is also disadvantageous in heavier fabrics, as it must be taken into account when the pattern is being made—the contours of the pattern must be corrected in relation to the desired final shape of the cut-out pieces of cloth to make allowance for the fact that the cloth expands in a widthwise direction and becomes shorter in the lengthwise direction of the web of cloth when it is removed from the cloth laying table after the cutting operation.

The object underlying the invention is to produce a cloth laying machine which also enables particularly light-weight fabrics to be laid out unproblematically, without interfering folds forming during the subsequent cutting out operation. The achievement of this object is based on a conventional cloth laying machine for laying out on a supporting surface superimposed layers of cloth drawn off from a web of cloth supply, comprising a cloth laying carriage supporting the web of cloth supply and reciprocating above the supporting surface, with which at least one respective layer of cloth can be deposited behind the cloth laying carriage at least when the latter moves in one of the two directions of travel (the direction of travel when the cloth is laid out). In accordance with the invention, such a cloth laying machine is provided with a blower means for generating an air current flowing from above towards the layer of cloth that is to be or has been laid out, in order to attain the sought object. Such non-contact smoothing of the layers of cloth during the laying out of the cloth on the cloth laying table has the great advantage that also particularly light-weight fabrics cannot be damaged thereby, whereas smoothing by a mechanical device, for example, a bar dragged along by the cloth laying carriage would always harbor the danger of causing an additional distortion in the longitudinal direction and, for instance, pulling fibers out of the fabrics. Directing air at the cloth shortly before it is laid out on the base is particularly recommendable for light-weight fabrics because this increases the laying out speed and, consequently, the cloth laying carriage can be driven at a higher speed. In such a case, it is beneficial to direct the air current at the curvature formed by the cloth drawn off from the web of cloth supply during its deflection into the horizontal. In a preferred embodiment of the cloth laying machine according to the invention, the blower means is so constructed that the air current has an outwardly directed component on either side of the center of the web of cloth to thus enable particularly effective elimination of the longitudinal distortion created during the drawing off of the cloth from the web of cloth supply. The effect of the blower means is then the same as if the cloth laid out by the cloth laying carriage were smoothed and stretched from the center of the web of cloth towards both sides.

A downwardly directed air current could be generated above the entire supporting surface or a blower means be made to follow the cloth laying carriage along rails mounted above the cloth laying machine. It is, however, simpler for the blower means to be mounted on the cloth laying carriage so as to blow the uppermost layer of cloth flat while it is still being laid out.

Fabrics can be laid out by cloth laying machines such that the cloth laying carriage lays out a layer of cloth only when travelling in one direction and then returns empty. There are, however, also cloth laying machines, for example, the constructions described in the publications mentioned at the beginning, wherein the cloth laying carriage lays out one respective layer of cloth in each direction of travel. In this connection, it is self-evident that more than one web of cloth could be laid out simultaneously both when the laying out takes place in only one and in both directions of travel of the cloth laying carriage, i.e., that two or more layers of cloth could be simultaneously deposited on the cloth laying table. This, however, has no influence on the application of the teaching according to the invention. When the invention is applied to cloth laying machines having a cloth laying carriage comprising at least one deflector means extending transversely to its direction of travel for deflection of the web of cloth drawn off from the supply and for deposition of the layer of cloth behind the cloth laying carriage, it is recommendable to mount the blower means behind the deflector means, in the direction of travel of the cloth laying carriage when the cloth is laid out, so as to blow each layer of cloth flat while it is still being laid out, i.e. before the blow flattening is impeded by the difficulty with which the respective area of the layer of cloth is later displaceable on the base. A cloth laying machine which deposits layers of cloth in both directions of travel is preferably provided with two blower means, more specifically, in front of and behind the place where the web of cloth is approximately deflected into the horizontal.

It is particularly beneficial if the blower means is so constructed that the outwardly directed component of the air current increases as the distance from the center of the web of cloth increases, so that the areas of the layers of cloth are pressed outwardly all the more, the further they are from the center of the web of cloth.

The blow flattening of the laid out cloth in accordance with the invention not only serves to eliminate a longitudinal distortion caused by drawing off the web of cloth from the web of cloth supply, but also the longitudinal distortion already created when the cloth was wound up to form the web of cloth supply. Thus, use of the cloth laying machine according to the invention eliminates the hitherto customary pattern correction mentioned above.

Further features, advantages and details of the invention are evident from the enclosed claims and/or the following description and the likewise enclosed drawings of a preferred embodiment of a cloth laying machine according to the invention.

Figure 1:
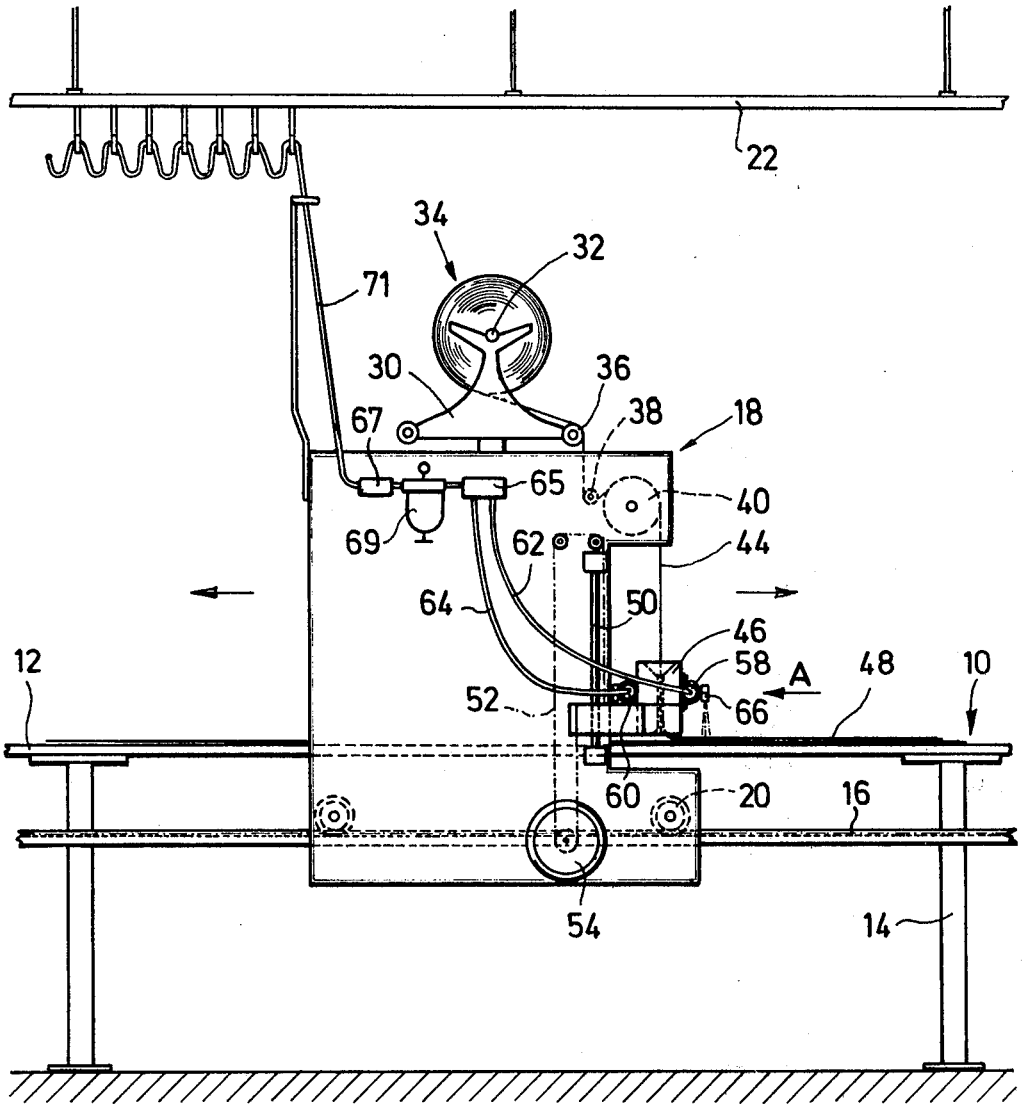
FIG. 1 is a schematic side view of the cloth laying machine with part of its cloth laying table.

FIG. 1 shows a cloth laying table designated in toto 10, with a table plate 12 on which the layers of cloth are to be laid out in superimposed relationship. Secured to the legs 14 of the cloth laying table, on either side thereof, are rails 16 with a cloth laying carriage 18 running along them and thus reciprocating along the cloth laying table 10 in the direction of the two arrows. The cloth laying carriage can be driven by an electric motor mounted in the cloth laying carriage and by one of the wheels 20 rolling along the rails 16, which is then constructed as a gear, for example, in the shown manner, and meshes with a toothing on the upper side of one of the rails 16. In order to provide the unshown electric motor of the cloth laying carriage 18 with the necessary electric energy it is common practice to suspend from the ceiling of the building above the cloth laying table 10 a guide rail 22 from which a cable dragged along by the cloth laying carriage is suspended.

On the cloth laying carriage 18 there are supports 30 for the axle 32 of a roll-shaped web of cloth supply 34, from which the web of cloth is drawn off over rollers 36 and 38 by a draw-off roller 40, whose rotational speed is in such proportion to the speed of travel of the cloth laying carriage 18 that the web of cloth is drawn off from the web of cloth supply 34 at the speed of travel of the cloth laying carriage. This can be achieved by, for example, establishing a drive connection, for instance, in the form of a chain, between one of the wheels 20 and the draw-off roller 40. The web of cloth 44 drawn off from the web of cloth supply 34 then runs through a deflector means 46, mounted on the cloth laying carriage 18, which re-routes the web of cloth during travel of the cloth laying carriage 18 such that it moves into the horizontal. Thus, the cloth laying carriage indicated in FIG. 1 as travelling to the left deposits behind it one respective layer of cloth 48 on the table plate 12 or on the previously laid out layers of cloth. The deflector means 46 is slidably guided in a vertical direction by columns 50 on the cloth laying carriage 18 and can thus be raised by way of a chain 52 in accordance with the increasing thickness of the layers of cloth. This can be done, for example, by handwheel 54.

Figure 2:
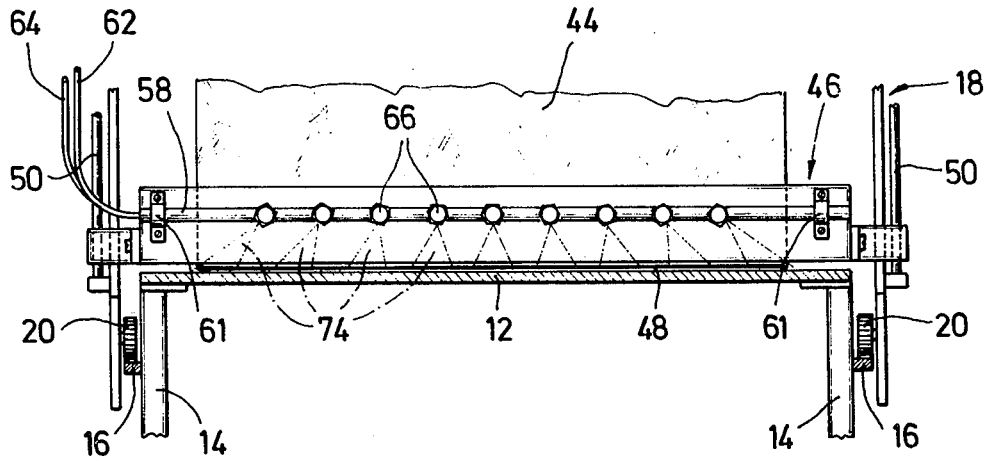
FIG. 2 is a view of the part of the cloth laying carriage comprising the blower means, viewed in the direction of arrow A in FIG. 1.
Figure 3:
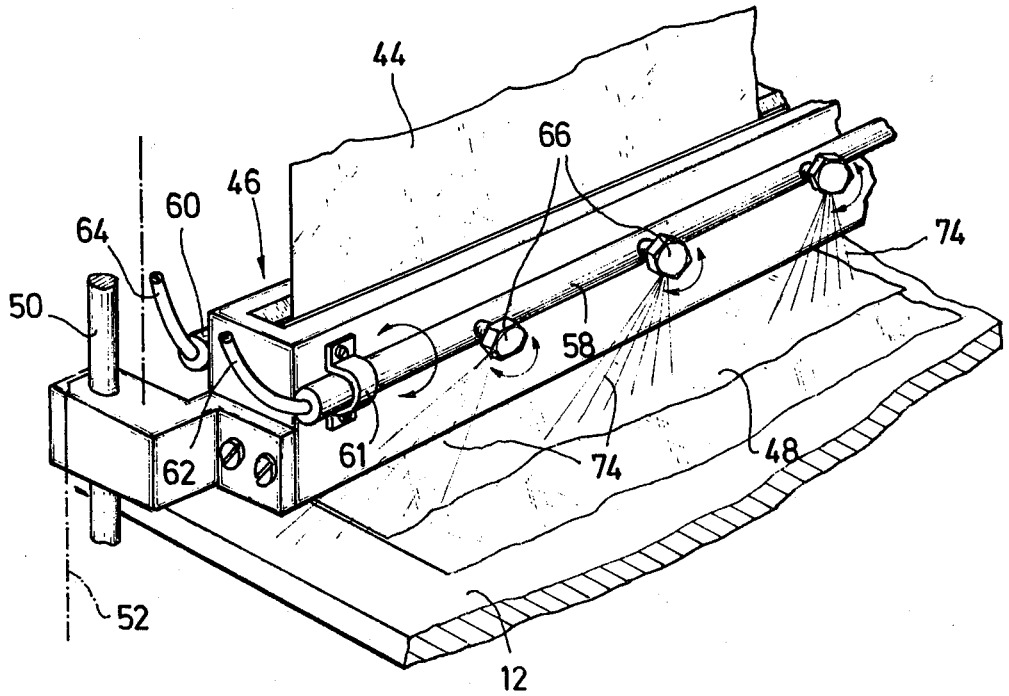
FIG. 3 is a perspective illustration of the left part of the blower means shown in FIG. 2.
Figure 4:
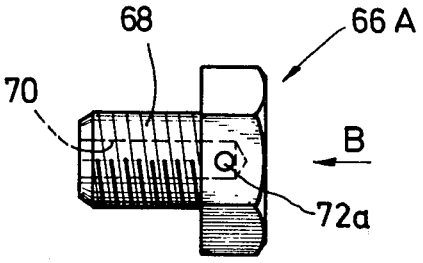
FIGS. 4 to 7 are views of two embodiments of preferred air outlet nozzles of the blower means.
Figure 5:
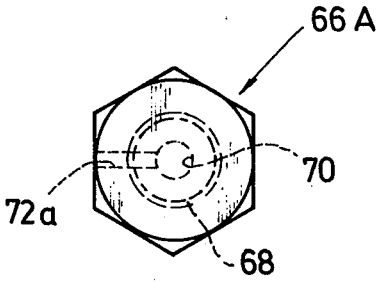
Figure 6:
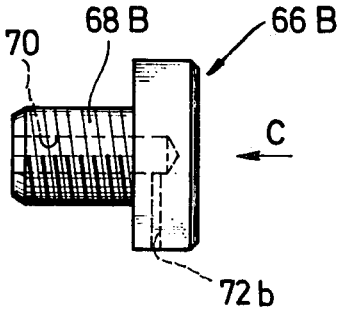
Figure 7:
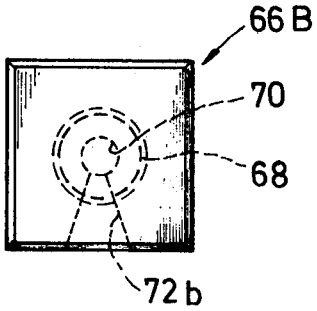

As shown in FIGS. 1 to 3, there is provided, in accordance with the invention, on each side of the deflector means 46, one pipe 58, 60, respectively, mounted by means of clamps 61 such that each of the pipes can be turned about its longitudinal axis, thus adjusted and then secured in position by tightening the clamps. The pipes 58 and 60 are closed at their ends and compressed air tubes 62 and 64 can be connected to the front ends, as shown in FIG. 3, for example, by unshown couplings. These compressed air tubes lead to a change-over valve 65 shown in FIG. 1, upstream of which an oil and water separator 69 and a pressure reducing valve 67 are provided. The entire apparatus is connected to an unshown compressed air source through a compressed air line 71 suspended from the guide rail 22 and dragged along by the cloth laying carriage 18. The change-over valve 65 enables only the one of the two pipes 58 and 60 that is located at the rear, in the direction of travel, to be supplied with compressed air, while the strength of the flow of air can be adjusted by the reducing valve 67.

As is evident from FIGS. 1 to 3, each of the pipes 58 and 60 is provided with a row of air outlet nozzles 66 which are arranged in transversely spaced relationship and are rotatable and adjustable about axes approximately parallel to the longitudinal direction of the table plate 12, as indicated by two-headed arrows in FIG. 3. FIGS. 4 to 7 show two embodiments of these nozzles, which advantageously each comprise one threaded shaft 68 with a longitudinal bore 70 to enable them to be screwed into corresponding threaded bores in the pipes 58 and 60. The nozzle 66A shown in FIGS. 4 and 5 comprises a simple transverse bore **72*a*, which extends into the longitudinal bore 70, while the nozzle 66B shown in FIGS. 6 and 7 has an air outlet slit 72*b* provided therein extending into the longitudinal bore 70 and expanding outwardly in a fan-like fashion. The air currents that can be generated with the nozzle 66B are illustrated in FIGS. 2 and 3**.

The nozzles 66 are advantageously regulated in the manner shown in FIGS. 2 and 3, i.e., such that the air currents 74 flow down in an approximately vertical direction at the center of the web of cloth, but extend at an increasing outward incline as the distance between the respective nozzle and the center of the web of cloth increases, so that the layer of cloth 48 which has just been laid out is not only blown flat but also stretched in a transverse direction. This effect can, of course, be obtained with both air outlet nozzles illustrated in FIGS. 4 to 7.

It may be expedient to construct the change-over valve 65 such that the blower means is selectively actuatable in only one or in both directions of travel of the cloth laying carriage 18.

We claim:

1. A cloth laying machine for laying out on a supporting surface superimposed layers of cloth drawn off from a web of cloth supply having two longitudinal edges and a longitudinally extending center area therebetween, said cloth laying machine comprising a cloth laying carriage for drawing off a web of cloth from said supply and for guiding said web, means for reciprocating said carriage above the supporting surface in two directions of travel for deposition of at least one respective layer of cloth by said cloth laying carriage at least when said cloth laying carriage moves in one of the two directions of travel, said supporting surface being substantially horizontal, a blower means located above the topmost layer of cloth, said blower means being supplied with a positive air pressure for generating an air current flowing from above and directed downwardly towards a substantially horizontal layer of cloth that has been laid out, said blower means being disposed so that the air current has flow components directed outwardly from said center area to either edge of said layer of cloth.

2. Cloth laying machine as claimed in claim 1, wherein at least part of said air current is directed at a slope to the cloth to flatten and stretch the cloth that has been laid out.

3. Cloth laying machine for laying out on a supporting surface superimposed layers of cloth drawn off from a web of cloth supply having two longitudinal edges and a longitudinally extending center area therebetween, said cloth laying machine comprising a cloth laying carriage for drawing off a web of cloth from said supply and for guiding said web; means for reciprocating said carriage above the supporting surface in two directions of travel for deposition of at least one respective layer of cloth by said cloth laying carriage at least when said cloth laying carriage moves in one of the two directions of travel, said supporting surface being substantially horizontal, a blower means located above the topmost layer of cloth, said blower means being supplied with a positive air pressure for generating an air current flowing from above and directed downwardly towards a substantially horizontal layer of cloth being laid out, said blower means being disposed so that the air current has flow components directed outwardly from said center area to either edge of said layer of cloth.

4. Cloth laying machine as claimed in claim 3 or 1 wherein the blower means is mounted on the cloth laying carriage.

5. Cloth laying machine as claimed in claim 4 having a cloth laying carriage comprising at least one deflector means extending transversely to the direction of travel of said cloth laying carriage for deflection of the web of cloth drawn off from the supply and for deposition of the layer of cloth from the cloth laying carriage, wherein the blower means is mounted behind the deflector means.

6. Cloth laying machine as claimed in claim 3, or 1, wherein the blower means comprises several air outlet nozzles arranged in spaced relationship transversely to the direction of travel.

7. Cloth laying machine as claimed in claim 6, wherein the air outlet nozzles are mounted on the cloth laying carriage for adjustment of the direction of flow of the air current emanating therefrom.

8. Cloth laying machine as claimed in claim 7, wherein the air outlet nozzles are pivotable about an axis extending transversely to the direction of travel.

9. Cloth laying machine as claimed in claim 7, wherein the air outlet nozzles are pivotable about an axis extending in the direction of travel.

10. Cloth laying machine as claimed in claim 3 or 1, wherein the blower means comprises a pipe extending transversely to the direction of travel and connectable to a compressed air source.

11. Cloth laying machine as claimed in claim 10, wherein the pipe is mounted on the cloth laying carriage for rotation about its own longitudinal axis.

12. Cloth laying machine as claimed in claim 10, wherein air outlet nozzles are mounted on the pipe.

13. Cloth laying machine as claimed in claim 3 or 1, characterized in that a separator for liquids is provided upstream of the blower means.

14. Cloth laying machine as claimed in claim 3 or 1, wherein a valve for adjustment of the strength of the air current is provided upstream of the blower means.

15. Cloth laying machine as claimed in claim 3 or 1, wherein the blower means includes a switch means for selectively actuating said blower means between operation in only one and in both directions of travel of the cloth laying carriage.

16. Cloth laying machine as claimed in claim 3 or 1 wherein the outwardly directed flow components of the air current increase as the distance from said center area of the web of cloth increases.

17. Cloth laying machine as claimed in claim 3, wherein at least part of said air current is directed at a slope to the cloth to flatten and stretch the cloth being laid out.

* * * * *

UNITED STATES PATENT AND TRADEMARK OFFICE

CERTIFICATE OF CORRECTION

PATENT NO. : 4,438,914

DATED : March 27, 1984

INVENTOR(S) : Roland Stengle and Rolf Grupp

It is certified that error appears in the above-identified patent and that said Letters Patent is hereby corrected as shown below: On the title page The first inventor's name listed, "Rolf Stengle" should read --Roland Stengle--.

The assignee's name should have been printed as follows:

--Assignee: Krauss u. Reichert GmbH & Co. KG
Spezialmaschinenfabrik, of
Fellbach, Fed. Rep. of Germany --.

Column 1, line 9, after "off" insert the word --from--.

Signed and Sealed this

*Twentieth* Day of *November 1984*

[SEAL]

*Attest:*

GERALD J. MOSSINGHOFF

*Attesting Officer*

*Commissioner of Patents and Trademarks*